United States Patent [19]

Malone

[11] 4,235,593

[45] Nov. 25, 1980

[54] BLAST STOVE

[75] Inventor: William H. Malone, Northfield, Ohio

[73] Assignee: Republic Steel Corporation, Cleveland, Ohio

[21] Appl. No.: 24,388

[22] Filed: Mar. 27, 1979

[51] Int. Cl.[3] ..... F27D 1/16

[52] U.S. Cl. ..... 432/217; 432/40; 432/3; 165/9.3; 266/139

[58] Field of Search ..... 432/214, 217, 30, 40, 432/247, 249, 251, 252, 261, 3; 165/9.1, 9.3, 9.4; 266/139

[56] References Cited

U.S. PATENT DOCUMENTS

| | | | |
|---|---|---|---|
| 1,860,368 | 5/1932 | Seaver | 432/217 |
| 1,916,370 | 7/1933 | Hayes, Jr. et al. | 165/9.3 |
| 1,983,017 | 12/1934 | Bowland | 165/9.3 |
| 2,198,054 | 4/1940 | Linder | 432/217 |
| 2,428,461 | 10/1947 | Kinney et al. | 432/217 |
| 3,006,626 | 10/1961 | Lejeck et al. | 165/9.4 |
| 3,135,505 | 6/1964 | Agnew | 165/9.3 |
| 3,488,041 | 1/1970 | Powell et al. | 432/217 |
| 3,591,153 | 7/1971 | Powell et al. | 165/9.3 |
| 3,625,494 | 12/1971 | Allen | 432/217 |
| 3,764,260 | 10/1973 | Smith, Jr. | 432/217 |

*Primary Examiner*—Henry C. Yuen

*Attorney, Agent, or Firm*—Watts, Hoffmann, Fisher & Heinke Co.

[57] ABSTRACT

A blast stove having adjoining combustion and checker chambers, for use with a blast furnace. A support structure, mounted within the checker chamber, supports tiers of interlocked checkerbricks. The support structure includes vertically extending columns which loosely engage a series of transversely extending girders. The girders supportively engage a plurality of grid bar assemblies, each assembly including a plurality of grid bars maintained in a spaced relation by transverse rods and spacers welded to the bars and further including interlocking apparatus for engaging the underlying girders and an adjacent grid bar assembly. The grid bar assemblies support a plurality of grid shoes having grid assembly engaging grooves for interlocking the grid shoes to the grid bar assemblies. The top surface of the grid shoes include recesses which receive bosses located on the underside of the checkerbricks so that the first layer of checkerbricks, is engaged by the shoes. Each of the engagements is provided with an appropriate clearance to accommodate the expected movement caused by the thermal stresses in the structure. Relative movements in any lateral direction between engaged members is constrained to predetermined limits.

29 Claims, 17 Drawing Figures

BLAST STOVE

BACKGROUND OF THE INVENTION

The present invention relates generally to blast stoves and in particular to a structure for supporting checkerbrick within the stove.

Blast stoves are employed in iron making processes to preheat the combustion air before entry into a blast furnace. Typically, a blast stove is a silo shaped structure constructed or refractory and insulating brick and surrounded by a metallic shell. Adjoining combustion and regenerative chambers are enclosed within the structure and communicate through a passage formed by a domed top.

The regenerative or checker chamber includes tiers of refractory brick which fill a major portion of the chamber volume. This checkerbrick generally includes aligned flow passages which extend from the top to the bottom of the checkerwork.

A blast stove has two cycles of operation—a heating cycle and a blast cycle. During the heating cycle, combustible gases generated during iron making by an associated blast furnace are introduced into the combustion chamber through a valve controlled port along with an appropriate amount of combustion air at the bottom of the chamber and then burned. The burning gases travel upwardly to the top of the stove, then down through the checkerwork, and finally out through a valve control port at the bottom of the checker chamber. The heat of combustion of the burning gases is absorbed by the checkerbrick and once the checker-work reaches a predetermined temperature, the heating cycle is terminated and the blast cycle is initiated. In the blast cycle, air is introduced at the base of the checker chamber, is heated as it travels through the checkerbrick and then is conveyed from the combustion chamber to the blast furnace.

The repetitive thermal cycling of the blast stove, subjects the structure to substantial thermal related stresses. The stress induced movement in various structural components, if not controlled, may precipitate catastrophic, fatigue and creep related failures in the blast stove. This movement is gradual and results from the thermal cycling. In theory, each component will, during a thermal cycle, expand and then contract to its original position. In practice, frictional engagement between a member and its supports is often not uniform and as a consequence the member will move slightly during each thermal cycle. With prior structures, such member movement accumulated over repetitive thermal cycles.

Because of this accumulated movement, it was not uncommon, for example, to find after a few years of use, that portions of the checkerwork support structure have moved beyond permissible limits. As a result, the checkerbrick is no longer uniformly supported and the structure may become dangerously unstable.

An even more common occurrence is one in which the accumulated structure and checkerbrick movement is random, causing a misalignment of the flow passages in the checkerbrick. This misalignment will substantially restrict flow through the checker-work. Because the efficiency of the blast stove is directly related to the rate of air flow it is able to sustain, once the checkerbrick becomes excessively misaligned, the blast stove is rendered substantially useless.

Prior art structures have been suggested to deal with thermal induced structural movements, but none have proved totally effective. One such attempt has suggested the placement of a layer of metallic "shoes" on a grid supported by parallel girders. The "shoes" are configured to engage the first layer of checkerbrick layed upon it. The configuration, however, allows the uncontrolled movement between the metal shoe engaged by the brick and the grid work which supports the layer of metal shoes. Moreover, the checkerwork is not constrained from moving into or against the interior wall of the blast stove.

A second suggested structure would use a "filler brick" in some of the flow passages of the bottom layer of checkerbrick to extend down into the grid work supporting the first layer of checkerbrick, to interlock the checkerbrick to the grid work. It would appear that in this structure, the flow passages through the checkerbrick would be obstructed by the required filler brick.

Still another suggested supporting structure would use a layer of metallic shoes, each having a downwardly extending lug to engage a supporting, parallel grid work below the layer. This configuration would limit the lateral movement of the grid shoe with respect to the grid in one direction only.

Finally, a more recent proposal would utilize a labyrinth of girders and grid bars for supporting the checkerwork. To maintain the spatial distances between the members, spacers and pivotal connections are employed at various locations. This construction is unduly complex and possibly does not allow sufficient movement in response to the thermal stresses, that are experienced in use.

SUMMARY OF THE INVENTION

The present invention provides a new and improved checkerwork support structure in which controlled, limited movement is allowed among the structural members to accommodate thermal generated stresses. The allowed movement is constrained to predetermined limits so that small minute noncatastrophic movements do not accumulate over the life of the blast stove to precipitate a creep or fatigue induced failure.

According to a preferred embodiment of the invention, the structure includes a plurality of parallel spaced apart girders supported and loosely engaged by a plurality of vertically extending columns, sometimes referred to as blooms. The engagement between the columns and girders allows movement within predetermined limits in any lateral direction. A plurality of grid bar assemblies is supportively engaged on top of the support girders. Each grid bar assembly comprises a plurality of grid bars extending transversely to the girders. The spatial relation between the grid bars of a given assembly are maintained by transverse members fixed to adjacent grid bars. The assembly further includes interlocking apparatus which interlocks the assembly to the girder and to an adjacent assembly of grid bars. The interlocking apparatus allows controlled, limited movement between interlocked grid assemblies and between the grid assemblies and the support girders.

A significant advantage of the disclosed support structure resides in the provision made for thermal induced movements in the structure. Both the lateral and vertical engagements among the various component members are configured to allow relative movement between the members within safe limits so that damage to the structure and/or the blast stove wall is prevented.

According to a feature of the invention, the grid bar assemblies are interlocked to each other by a pin and slot arrangement. A plate containing the slot is attached to the end of certain assemblies and extends in a direction parallel to the grid bars. The slot in the plate is configured to receive a transverse rod extending through the grid bars of an adjoining grid bar assembly. Clearance is provided between the slot and the engaged rod so that the interlocked assemblies can move relative to each other within predetermined limits. Each grid bar assembly further includes girder engagement plates attached at suitable locations. These girder engagement plates are positioned on the grid bar assembly so that when the assembly is placed on the underlying girders, the assembly will be interlocked to the girders such that only limited lateral movement between the girders and the grid bar assembly is allowed.

The configuration of the interlocking apparatus establishes the clearance and permissable limits of movement between the support members. The interlocking configuration also facilitates assembly of the blast stove. The grid bar assemblies and the girders are usually preassembled and prepared outside of the blast stove. The checkerbrick support structure is then constructed within the blast stove by setting down and interlocking component members.

According to another feature of the invention, grid shoes are provided which are interlocked to the grid bar assemblies; the shoes in turn interlock the first layer of checkerbrick. Unlike prior art systems, the checker shoes of the present invention are interlocked to the grid bars in a way that allows only limited movement in any lateral direction. To accomplish this feature, the grid shoes are provided with a series of slots which engage both the tops of the grid bars and tabs which extend transversely from the sides of certain grid bars. The grid shoes are dimensioned to support a plurality of checker bricks and the top surface of each grid shoe is provided with recesses which accept companion bosses on the bottom surface of the checkerbricks. The grid shoe also includes flow passages which are positioned in alignment with the flow passages in the checkerbrick. The engagement grooves on the underside of the grid shoe are located so that the flow passages are unobstructed by the grid bars below the grid shoe.

The grid shoes of the present invention provide distinct advantages over many prior art constructions. The interlocking arrangement allows limited movement between the grid shoes and the grid bar assemblies in any given lateral direction. The grid shoe to grid assembly interlocking coupled with the checkerbrick to grid shoe interlocking prevents the gradual migration or creep of the checkerwork which, if not constrained, would eventually result in blast stove damage.

It is a general object of this invention to provide a checkerbrick support structure which will accomodate thermal induced movements without damage to the structure or to the blast stove.

It is another object of this invention to provide an interlocked checkerbrick support structure which is easily assembled and manufactured.

Further features and advantages of the invention will become apparent in reading the detailed description made with reference to the accompanying drawings.

DESCRIPTION OF THE PREFERRED EMBODIMENT

Figure 1:
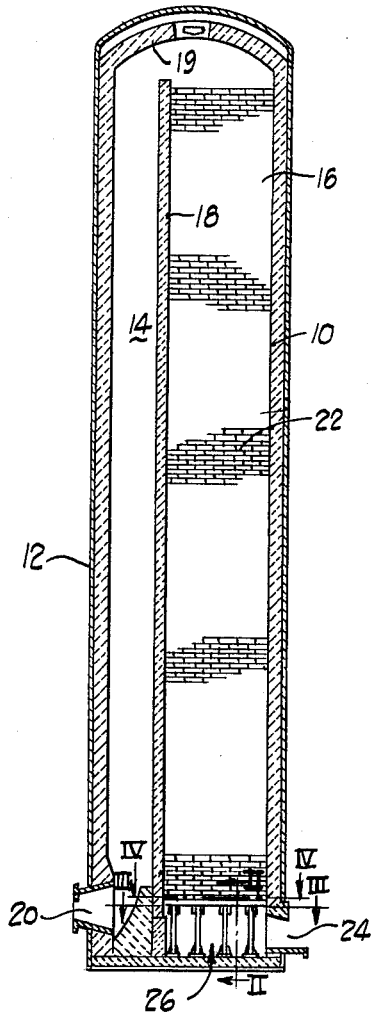
FIG. 1 is a schematic cross-sectional view of a typical blast stove embodying the present invention.

FIG. 1 depicts schematically, the construction of a typical blast stove used in the iron making process. In general it is a silo shaped structure having a wall 10 constructed of refractory and insulating brick, and encased by a metal shell 12. The stove includes a combustion chamber 14 and a checker chamber 16 defined by an internal refractory wall 18. The two chambers 14, 16 communicate via a passage formed by a domed top 19.

The checker chamber 16 houses tiers of refractory brick commonly called checkerbrick forming a checkerwork 22 which provides a heat storage function or essentially a heat reservoir. The heat stored in the checkerwork 22 is used to preheat blast furnace combustion air prior to entry into a blast furnace (not shown).

In operation, the blast stove alternates between a heating cycle and a blast cycle. During the heating cycle, exhaust gases are introduced into the combustion chamber 14 and burned, through a port 20 and are directed down through the checkerwork 22 by the domed top 19. The burning gases heat the individual checkerbricks as they pass through flow passages formed in the brick. The products of combustion then exit the stove through a port 24.

Once the checkerwork 22 has attained a predetermined temperature, the blast stove enters the blast cycle. During the blast cycle, outside air is introduced through the port 24 and passed up through the heated checkerwork 22 from which it absorbs heat prior to entering the blast furnace through the port 20.

Figure 2:
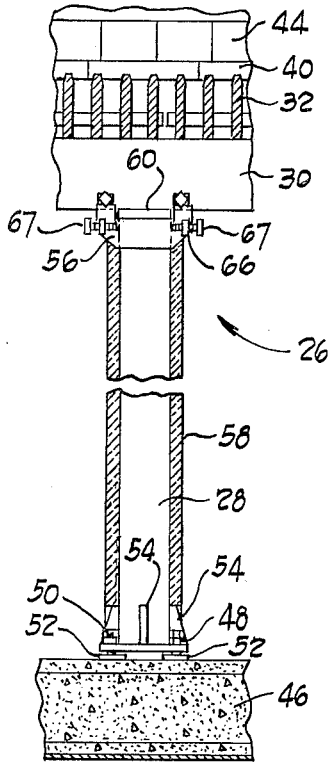
FIG. 2 is a side, fragmentary view partly in cross-section and partly in elevation, of a checker support structure along line II—II of FIG. 4.
Figure 3:
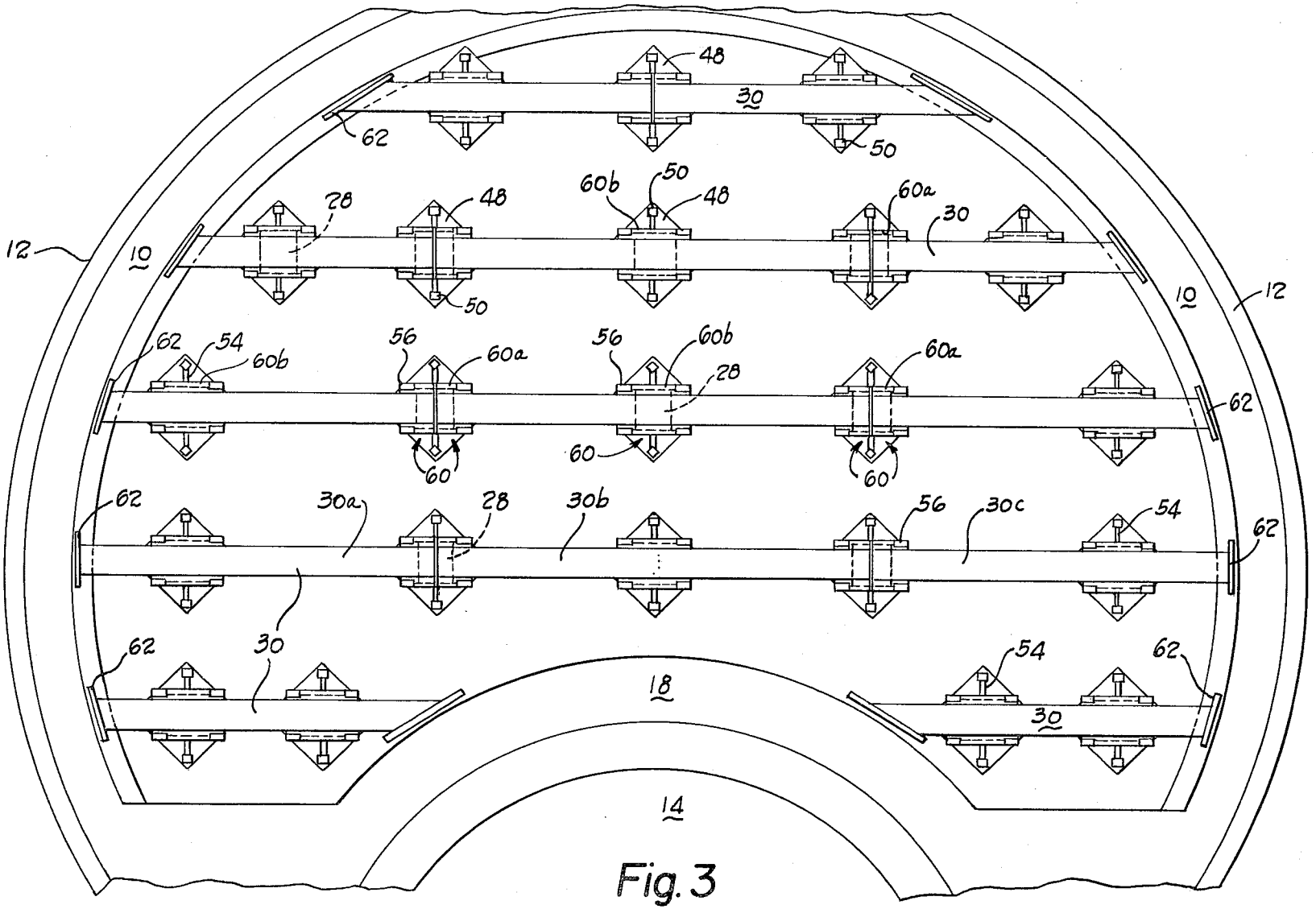
FIG. 3 is a plan view of the blast stove girder support structure along line III—III of FIG. 1.
Figure 4:
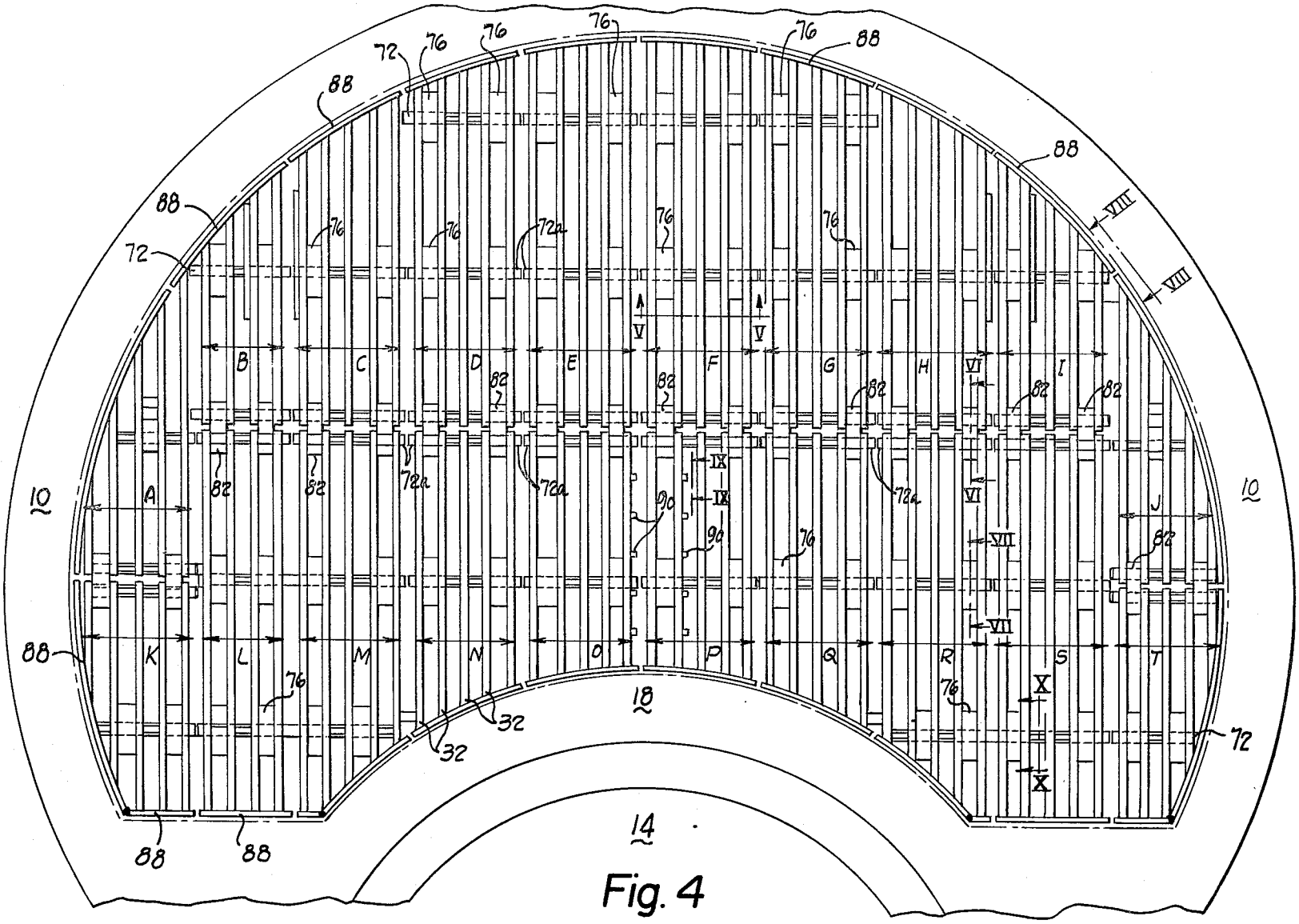
FIG. 4 is another plan view of the blast stove structure showing the construction and placement of the grid bar assemblies along line IV—IV of FIG. 1.
Figure 5:
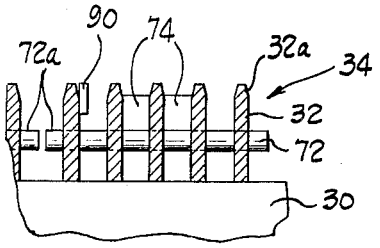
FIG. 5 is a sectional view along line V—V of FIG. 4.

According to the invention the checkerwork 22 is supported in the checker chamber 16 by support structure indicated generally in FIG. 1 by the reference character 26. Referring to FIGS. 2, 3 and 4, the support structure 26 of the present invention includes a plurality of vertically extending columns 28 sometimes referred to as blooms, which engage and support a plurality of laterally extending girders 30. The girders 30 engage and support a series of parallel, transversely extending, grid bars 32. The grid bars 32 are fashioned into assemblies, each assembly designated by the reference character 34 (FIG. 5). Each grid bar assembly engages both the support girders 30 and an adjacent grid bar assembly 34. A layer of metallic shoes, indicated as 40 in FIG. 2, is supported and engaged by the grid bar assemblies 34 and, in turn, supports and interlocks a first layer of checkerbrick indicated as 44 in FIG. 2. In accordance with the features of this invention, the engagements between the structural components of the support structure 26 are configured to allow a controlled, lateral movement but constrain the allowed movement to preset limits.

Referring to FIGS. 2 and 3, each column 28 extends vertically from a concrete foundation 46. The bottom of the column 28 terminates in a base plate 48 in which a plurality of leveling bolts 50 are threadedly engaged. The leveling bolts 50, in turn, confrontingly engage leveling plates 52 and are adjusted as required to true up the position of the columns 28 during assembly of the support structure. Gusset plates 54, mounted near the base of the columns 28, strengthen the connection between the column 28 and the base plate 48.

Figure 13:
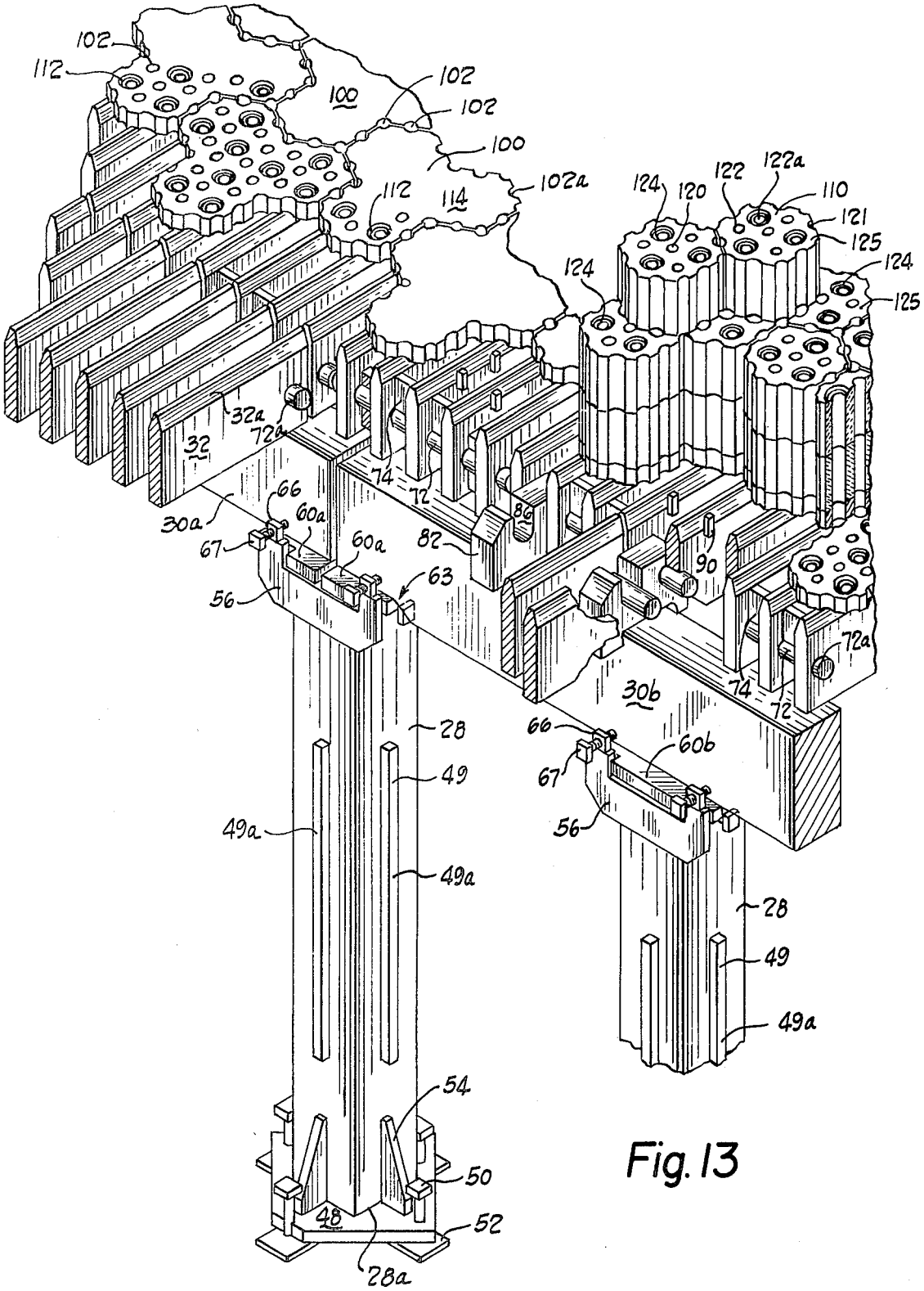
FIG. 13 is a fragmentary perspective view of the overall checkerbrick support structure of the present invention with portions omitted for clarity.

A pair of elongated bars 49 are fastened, preferably welded, to adjacent sides of the column 28, see FIG. 13. During the manufacture of the column 28, the surfaces 49*a* of the bars 49 are machined to provide reference surfaces for machining the end surfaces 28*a* of the column 28 to insure their parallelism. During assembly, the surfaces 49*a* are used to gage the position of the column 28 so that the contact between the girder and top surface of the column is uniform. After the support structure is assembled the base of each bloom 28 is "grouted in" to fill any void between the base plate 48 and the underlying foundation. Consequently, the grouting supports the weight of the structure not the leveling bolts 50.

The top of each column 28 terminates in a saddle arrangement formed by a pair of U-shaped plates 56. The exposed length of the bloom 28 is surrounded by insulating material 58 to minimize the thermal interaction between the column 28 and the air and exhaust gases passing through the blast stove thereby minimizing thermal induced dimensional changes in the columns. For purposes of clarity, the insulating material 58 has been omitted from FIG. 13.

As illustrated in FIG. 3, the columns 28 support the parallel girders 30 which extend across the checker chamber. Column engaging plates 60 are welded at spaced locations along the underside of the girder and are engaged by the column mounted saddles 56.

To facilitate assembly and to provide controlled thermally induced expansion and contraction, some of the support girders 30 are sectioned and are composed of individual members, for example, 30*a*, 30*b*, 30*c* (see FIG. 3) to form a girder 30 which extends across the checkerchamber 16. The junction of adjacent girder members, for example, 30*a*, 30*b* is supported by one of the columns 28. Thus, the column saddles 56 serve as a means for coupling the adjacent girder members.

Figure 12:
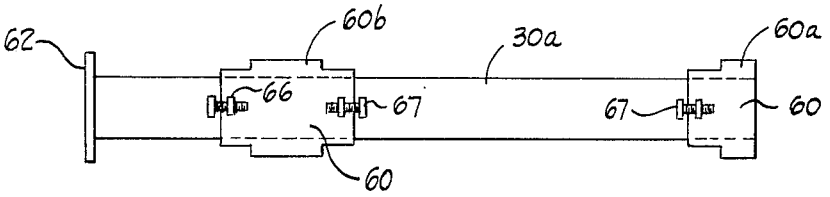
FIG. 12 is a bottom view of a girder member used in the present invention.

As shown in FIGS. 3 and 12, the engagement plates 60 near ends of the girder members are T-shaped including projecting portions 60*a* at the head of the T. The other engagement plates 60 (those disposed intermediate the ends of the girders 30) are in the shape of symmetrical crosses each of which include laterally extending, centrally located projecting portions 60*b*. Each portion 60*a* or 60*b* is between the pair of saddles 56 on a supporting column 28, to limit thermally induced longitudinal movement of the girders 30. In the case of the girder members 30*a*, 30*b*, both are jointly engaged by the column saddle 56 and the lateral movement of both is restrained.

The ends of the outermost girder members (for example 30*a*, 30*c*) terminate in bumper plates 62 which prevent the girders from moving into or piercing the refractory walls 10, 18. Each plate 62 is shaped so that it closely conforms to the refractory wall with appropriate clearance.

In accordance with the features of the invention, clearance is provided between the saddles 56 and the engagement plates 60 so that small thermal induced lateral movements in the girders can occur. This movement is constrained to preset limits determined by the amount of clearance provided. Clearance is also provided between adjacent girder members so that the members, for example, 30*a*, 30*b* can move relative to each other. Since there are preset limits to girder movement, gradual creeping of the girders due to the thermal cycling, is avoided.

Because the weight supported by a given girder member is dependant upon its location within the chamber, certain girder members, for example 30*b*, are cross sectionally larger than the other girders. As shown in FIG. 13, the lower surface of girder 30*b* is notched at one end (indicated by the reference character 63) so that it can be jointly engaged with a girder having a smaller cross-section, by the saddle 56. This construction minimizes cost in that cross sectionally larger girders are used only in those locations where necessary.

The construction of the column 28 and girder support structure 26 in addition to providing the necessary clearance between the member engagements, also facilitates assembly of the blast stove. Because the weight of the structure is relied on to maintain the engagement between the girders 30 and columns 28, additional fabrication operations are unnecessary to fasten the girders to the columns.

During assembly of the column/girder structure, a variety of methods can be employed to preset the clearance between the members. One such method is the placement of wood of an appropriate thickness between the members in areas where the clearance is desired. For example, wood of appropriate thickness would be placed between girder members 30*a*, 30*b* and between the saddles 56 and the engagement plates 60, to establish the desired clearances at these locations. The first time the stove is used, the heat of combustion will burn away the wood spacers and the members will be free to move in response to thermal induced dimensional changes. Occasionally, it has been found that remnants of the wood spacers may remain between the members and for this reason an alternative method for establishing the clearances is provided by this invention. As shown in FIGS. 12 and 13, a plurality of nuts 66 are fastened, preferably welded to the saddles 56 and to the engagement plate 60 and readily receive adjusting bolts 67. During assembly, the girders are laid upon the columns 28 and the adjusting bolts 67 are adjusted to jack the girders to appropriate positions relative to the columns 28 to establish the clearances. After the structure is completely assembled, the bolts 67 are removed so that the members will be free to move in response to thermal induced movements.

Figure 11:
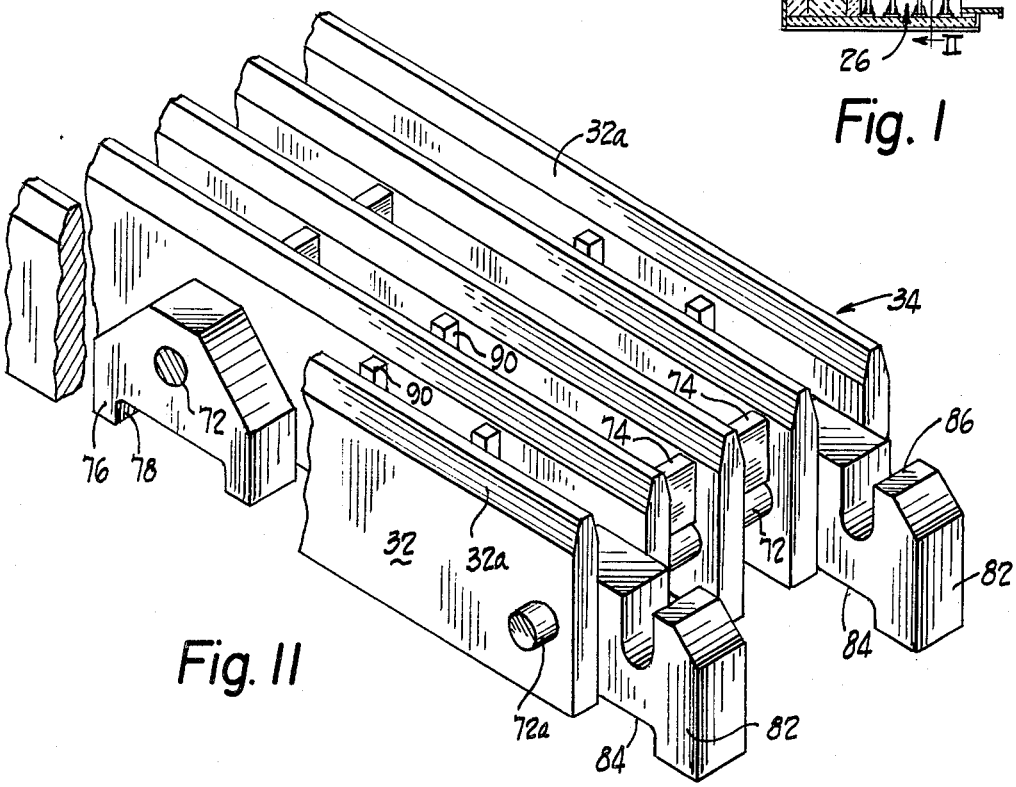
FIG. 11 is fragmentary perspective view of a grid bar assembly of the present invention with portions of the assembly broken away to show internal structure.

As mentioned earlier, the girders 30 form the support for a series of assemblies 34 of transversely extending grid bars 32 which, in turn, support a layer of metallic grid shoes 40. A portion of one of the assemblies 34 is shown in FIG. 11. Each grid bar assembly 34 is supported by the underlying support girders 30 in closely spaced relationship with adjacent grid bar assemblies 34. Once the grid bar assemblies 34 are placed upon and engage the support girders 30, a uniform grid shoe supporting surface results.

In the preferred checkerbrick support structure 26, each grid bar assembly 34 is distinct from the other. Each is sized and configured to fit a particular location in the checker chamber 16. For convenience each assembly is designated in FIG. 4 by one of the letters A thru T. Certain of the assemblies each include an apparatus for engaging and interlocking an adjacent grid bar assembly 34. The interlocked assemblies, form a series of parallel grid bars which extend across the checker chamber 16. According to a feature of the invention, the engagements between the grid bar assemblies 34 are constructed to accommodate and control small thermal induced relative movements.

Figure 10:
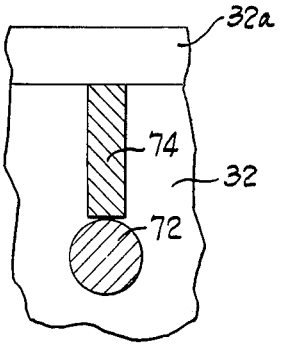
FIG. 10 is a sectional view along line X—X of FIG. 4.

Although each assembly 34 is distinctive, all embody similar features of the invention. Referring to FIGS. 5 and 11, each of the elongate bars 32 have tapered top portions 32*a*. Laterally extending grid bar connectors in the form of transverse rods 72 extend through and are welded to each bar 32 of a grid bar assembly 34. The ends of the rod 72 (designated as 72*a*) extend beyond the outermost grid bars of a given assembly to form a spaced abutment for a contiguous grid bar assembly. Spacing plates 74 are welded between adjacent grid bars at various locations to provide added rigidity. As shown in FIG. 10, the spacing plates 74 are mounted above the rod 72 and extend upwardly to the level where the tapered portion 32*a* begins.

Figure 7:
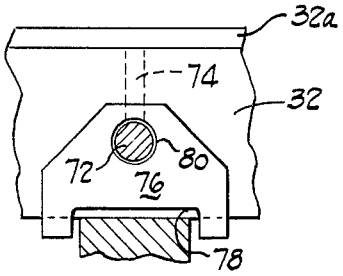
FIG. 7 is a sectional view along line VII—VII of FIG. 4.

The grid bar assembly 34 also includes girder engagement plates 76 rotatably mounted to the transverse rod 72 at spaced locations, FIGS. 7 and 11. Alternately, the plates 76 can be welded to either the rod 72 or to adjacent grid bars 32. As shown in FIG. 7, each plate 76 is preferably triangularly shaped and includes a slot 78 for engaging a girder 30 and a rod receiving aperture 80, both sized to provide a clearance engagement between mating members.

Figure 6:
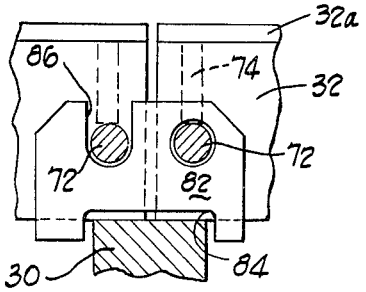
FIG. 6 is a sectional view along line VI—VI of FIG. 4.

Grid assembly interlocking latching and supporting plates 82, shown in FIGS. 6 and 11, are rotatably captured on the end most transverse rod 72 of certain grid bar assemblies 34, specifically, assemblies A thru J as shown. Each plate 82 extends beyond the end of its associated grid bar assembly to engage an adjoining assembly. Each plate 82 includes both a girder engaging slot 84, similar to the slot 78 provided in the plate 76 and additionally includes a vertically disposed slot 86 which loosely engages the transverse rod 72 of an adjacent grid bar assembly. The plates closely control the thermally induced, relative movements between adjacent assemblies.

The construction of the grid bar assemblies greatly facilitates the construction and fabrication of the checkerwork support 26. It allows individual grid bar assemblies 34 to be pre-assembled and then transported to the blast stove site where the assemblies are merely laid atop the girders 30 and coupled to each other; no welding or other fastening operations are required. The weight of the grid bars maintains the engagement. The loose co-engagement of the plate 82 with both the girders and adjacent assemblies and the plates 76 with the girders prevents gross movements due to thermal expansion and contraction due to thermal cycling.

Each grid bar assembly 34 also includes grid shoe engaging tabs 90 mounted to the individual grid bars 32 at spaced locations. As illustrated in FIGS. 4, 5, 7, and 11, each tab 90 extends laterally, outwardly from its grid bar 32 and includes an upper tapered portion 90*a* similar to that on the grid bar. The top surface of each tab is flush with or below the top surface of its associated grid bar assembly.

Figure 8:
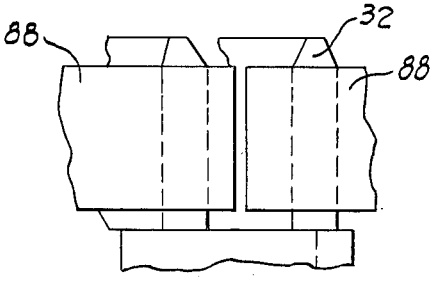
FIG. 8 is a sectional view along line VIII—VIII of FIG. 4.
Figure 9:
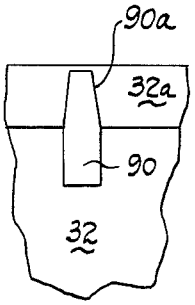
FIG. 9 is a sectional view along IX—IX of FIG. 4.

Bumper plates 88 are fastened to the individual grid bar ends on the end of the grid bar assemblies, which are adjacent the stove walls (FIGS. 4 and 8), to maintain their spaced relation and prevent the individual bars from piercing the refractory wall 10 if they move beyond the clearance provided. The bumper plates 88 are shaped and sized differently for each assembly 34 so that a discontinous peripheral metal ring, spaced from the refractory walls 10, 18, is formed once the assemblies 34A–34T are laid on and engaged by the girders 30. Clearance is provided between the ends of adjacent bumper plates 88, to allow some relative, noninterferring movement between them.

Referring to FIG. 4, it should be apparent that once the grid bar assemblies 34 are set in place and interlocked to adjacent assemblies and the support girders 30, movement between the various members due to thermal induced dimensional changes will be allowed within predetermined limits. The amount of movement, is determined by the clearance provided between the adjacent grid bar assemblies and the clearance provided at the girder engagements. The clearance between laterally against grid bar assemblies is determined by the clearance between confronting transverse rod ends 72*a* of the respective grid bar assemblies. The clearance between longitudinally adjacent grid bar assemblies is determined by the radial clearances between the latching plates 82 and the engaged transverse rods 72.

A significant feature of this invention lies in the provision made for limited movement of each of the individual members while preventing cumulative gross movement in the overall structure or its components. Thus, each engagement is configured to allow only limited lateral movement between engaged members.

Figure 14:
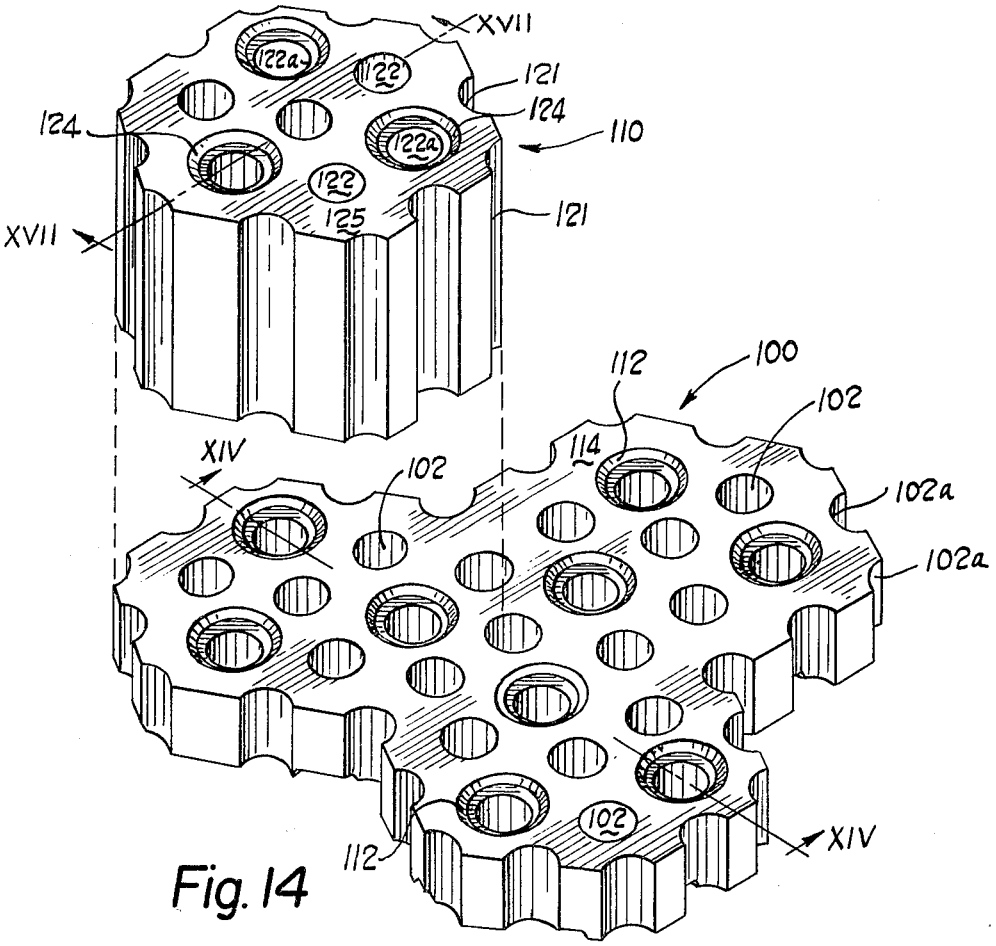
FIG. 14 is a perspective view of a grid shoe of the present invention and the checkerbrick it engages.

A layer of grid shoes (shown in FIG. 2 as 40) sits on top and is engaged by the grid bar assemblies 34. As shown in FIGS. 13 and 14, each grid shoe 100 includes a plurality of symmetrically disposed flow passages 102. Portions of flow passages 102*a* are also formed on the periphery of each grid shoe so that when the shoes 100 are layed on the grid bar assemblies, adjacent shoes will define additional flow passages 102. This construction provides uniformily distributed flow passages throughout the grid shoe layer 40.

Figure 15:
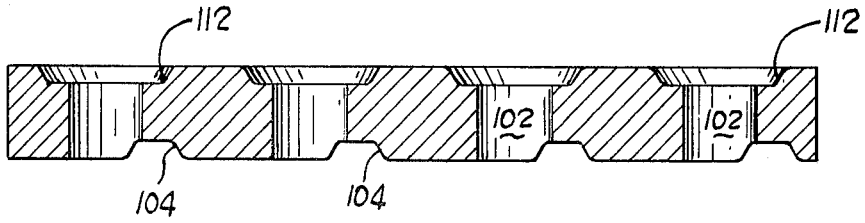
FIG. 15 is a cross-sectional view of the grid shoe along line XIV—XIV of FIG. 14.
Figure 16:
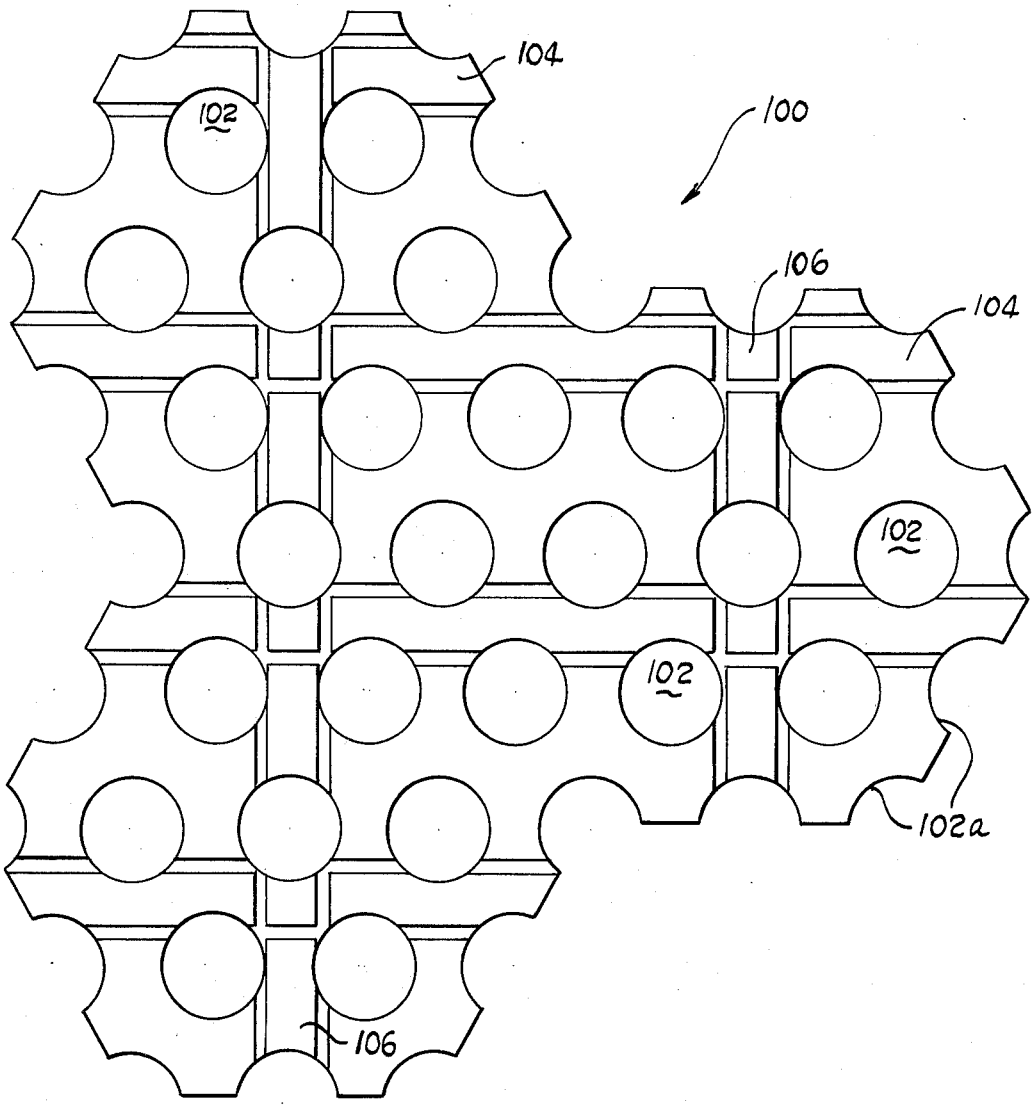
FIG. 16 is a plan view of the underside of the grid shoe of the present invention.

As shown in FIGS. 15 and 16, the under surface of each grid shoe includes a plurality of parallel grid bar and tab engaging grooves 104, 106 which extend in two transverse directions. The grooves 104 are located so that the tapered portions 32a of each of the grid bars supporting the particular shoe are engaged by one groove. The parallel set of grooves 106 transverse to the grid bar engaging grooves 104, are located to engage the tapered portions 90a of the tabs 90 extending from various grid bars 32. The combined engagement of the grid bars 32 and the tabs 90 positively locates each grid shoe 100. The perimetric dimension of the grid shoes 100 is chosen to provide a peripheral clearance between adjacent shoes and each groove 104, 106 is sized to provide a clearance fit between it and the engaged grid bar 32 or grid bar tab 90. Thus the grid shoe can move relative to the grid bars in any lateral direction within preset limits. The clearance is provided to accommodate thermal induced movements between the grid bars 32 and the grid shoes 100.

As shown in FIG. 16, the grid bar engaging grooves 104 extend between the flow passages 102 so that the flow of air through the passages 102 is not inhibited or interferred with by the supporting grid bars. The transverse grooves 106 which engage tabs 90 extend through the flow passages 102. The tabs 90, which engage these grooves, are located so that they will engage the shoe between the flow passages 102, and as a result do not restrict the flow of gas. This feature provides a grid shoe which is both interlocked to its support structure and has a minimal effect on the gas flow through the structure.

The layer of grid shoes 40, located and engaged on top of the grid bar assemblies 34, forms a uniform base for supporting the checkerwork 22. In accordance with the invention, each grid shoe 100 is preferably shaped to accommodate three hexagonal shaped checkerbricks 110 shown in FIGS. 13, 14, and 17. Recesses 112 in the top surface 114 of the grid shoe 100, surrounding certain of the flow passages 102, are provided for mating with companion bosses 116 located on the underside of each checkerbrick 110. Clearance is provided between the boss/recess engagement so that small non-catastrophic movements in the brick 110 due to thermal movement can be accommodated. A significant feature of this construction is the provision for supporting multiple checkerbricks on a single grid shoe 100 while concurrently providing a clearance engagement between the shoe 100 and brick 110. This construction insures that the first layer of checkerbricks 44 (FIG. 2) is positively located and aligned with the flow passages 102 in the grid shoes 100. Moreover the grid shoes 100 establish the permissible limits of lateral movement in the first layer of checkerbricks 44, the limits of movement being defined by the provided clearance.

Figure 17:
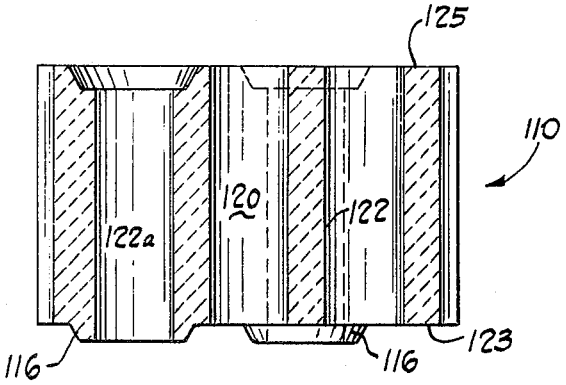
FIG. 17 is a cross-sectional view of the checkerbrick along line XVII—XVII of FIG. 14.

The construction of a checkerbrick 110 is shown in FIGS. 13, 14 and 17. It is a hexagonally shaped structure having a centrally disposed flow passage 120. Six symmetrically disposed flow passages 122 surround the central flow passage 120. The periphery of the checkerbrick 110 includes portions of flow passages 121 so that complete flow passages 122 are defined by adjacent bricks. The bosses 116 surround three of the flow passages 122a and depend from the lower surface 123 of the checkerbrick 110. The top surface 125 includes recesses 124 surrounding the same three flow passages 122a for receiving the boss or bosses 116 of other supported checkerbrick 110. The system of bosses 116 and recesses 124 form the means by which the individual checkerbricks 110 are interlocked to allow limited, but prevent gross relative lateral movement. As explained above, the first layer of checkerbricks 44 (shown in FIG. 2), is interlocked to the layer of grid shoes 40 which include similar recesses. All the checkerbricks 110 are thus interlocked to the base formed by the grid shoe layer 40.

Alternate checkerbrick constructions can be accommodated by this invention. An alternate construction, which is considered equivalent to that shown and it is known to be old in the art, is one that is also hexagonally shaped. It differs, however, in the placement of the recesses and bosses. In the alternate checkerbrick, two oppositely disposed complete flow passages (corresponding to passages 122 of the illustrated checkerbrick) are surrounded by recesses. Additionally, two of the partial or semi-partial flow passages (corresponding to 121 of the illustrated checkerbrick) include partial recesses. Bosses and partial bosses are located on the other end of the checkerbrick depending from the same complete and partial flow passages. Thus, a total of three complete recesses and corresponding bosses are defined in each checkerbrick. In order to accommodate this checkerbrick configuration, only minimal changes in the checker shoe would be required. Specifically, the location of the recesses 112 on the checkerbrick 100 would require modification.

Interlocking the first layer of checkerbricks 44 to the grid shoes 100 creates a uniform interlocked base on which to support the entire volume of checkerwork 22 in the checker chamber 16. Moreover, the alignment of the flow passages throughout the checkerwork 22 is automatic and additional aligning operations during the assembly of the blast stove are unnecessary. More importantly, thermal induced movements in the checkerbrick 110 will not excessively restrict the flow passages 102 because each checkerbrick 110 can only move a preset distance relative to the other checkerbricks to which it is engaged and substantial flow passage misalignments will not occur.

The clearance provided between component engagements throughout the checkerwork structure of this invention, will allow member movement in any lateral direction within preset limits determined by the clearance at the engagement. The clearance between engaged members is generally chosen to allow only enough movement to relieve the expected thermal stresses throughout the structure without causing catastrophic failure in the support structure, damage to the interior refactory wall, or excessive flow passage misalignment. The systematic interlocking of the structural components, although allowing some movement in any lateral direction, prevents a given component from migrating or creeping to a different location. The allowed movement in any direction is positively constrained.

Although the invention has been described with a certain degree of particularity, various modifications and changes can be made to it by those skilled in the art without departing from the spirit or scope of the invention as described in hereinafter claimed.

What is claimed is:

1. A blast stove heat storage construction comprising:
(a) a plurality of upwardly disposed load supporting columns;
(b) a plurality of girders mounted on the columns in loosely interlocked relationship to permit relative movement over a predetermined range;
(c) a set of grid bar assemblies mounted on the girders;
(d) each of the assemblies comprising:

(i) a plurality of grid bars positioned in spaced, parallel relationship; each gird bar including tapered upper surfaces;

(ii) a plurality of grid bar connecting rods extending through and connected to the grid bars for maintaining the grid bars in their parallel spaced relationship;

(iii) a plurality of support plates each rotatively mounted on a rod and each including a lower notch supportively engaging an associated girder in limited relatively movable relationship; and (iv) a plurality of shoe locating tabs each fixed to and projecting transversely of an associated grid bar, the tabs each including tapered upper surfaces; and, (e) certain of the assemblies including a plurality of latching and supporting plates each rotatively mounted on an associated rod, each of the latching plates including a movably upwardly oriented notch for loosely engaging a rod of another assembly to maintain relative assembly movement within predetermined limits;

(f) apertured checkerbrick shoes mounted on the assemblies and loosely interlocked with the tabs and grid bars to permit movement in any lateral direction within predetermined limits; and, (g) an interlocked array of checkerbricks mounted on the shoes.

2. The shoe of claim 1 wherein the configuration defined by the side walls corresponds to three such bricks in juxtaposed relationship.

3. A grid shoe for a blast stove construction utilizing bricks of hexagonal configuration comprising:

(a) a shoe having side walls defining a configuration substantially identical to a plurality of the hexagonal bricks to be stacked when such bricks are in juxtaposed relationship;

(b) the shoe having a plurality of through apertures shaped and positioned to be in gas flow aligned relationship with apertures of supported bricks;

(c) the shoe having a lower surface including grooves disposed transversely to one another for engaging a supporting grid assembly for relative motion within predetermined limits; and, (d) the shoe having an upper surface configured to achieve an interlocking relationship with supported bricks to permit limited relative lateral movement.

4. A process of fabricating a checker brick support assembly for a blast stove comprising:

(a) vertically positioning a plurality of blooms in spaced relationship;

(b) mounting a plurality of girders on the blooms while concurrently forming loosely fitting interlocking connections between the girders and blooms which permit thermally induced lateral relative movement within predetermined limits;

(c) mounting a plurality of grid bar assemblies on the girders while concurrently forming loosely fitting interlocking connections between assemblies and between the assemblies and girders which permit thermally induced lateral relative movement within predetermined limits; and, (d) mounting grid shoes on the assemblies in loosely fitting interlocking connections between the shoes and the assemblies to permit thermally induced relative lateral movement within predetermined limits.

5. For use in a blast stove checker chamber that includes checkerwork-supporting grid bars, a grid shoe comprising:

(a) structure dimensioned to support a plurality of checkerbricks;

(b) vertical flow passages disposed in said structure (c) a first set of grooves for engaging the grid bars, said grooves disposed in the bottom surface of said shoe and positioned between successive rows of flow passages;

(d) a transverse engagement means disposed on the bottom surface of said shoe, said grooves and transverse engagement means allowing controlled lateral movement within predetermined limits between the grid shoes and the grid bars; and, (e) checkerbrick engagement means disposed on the top surface of said shoes, said engagement means allowing controlled limited lateral movement between said shoes and said checkerbricks.

6. The grid shoe of claim 5 wherein said transverse engagement means comprises a second set of grooves positioned transverse to the first set.

7. A checkerbrick support assembly for a blast stove, comprising:

(a) a plurality of spaced, vertically positioned blooms;

(b) a plurality of girders mounted on the blooms and including loosely fitting interlocking connections that permit thermally induced, lateral relative movement between the girders and the blooms within predetermined limits;

(c) a plurality of grid bar assemblies mounted on and loosely interlocked to the girders, said mounting permitting thermally induced lateral relative movement between the assemblies and the girders within predetermined limits; and, (d) grid shoes mounted on and loosely interlocked to the assemblies, said mounting permitting thermally induced lateral relative movement between the shoes and the assemblies within predetermined limits.

8. In a blast furnace stove, a checker work support structure comprising:

(a) a plurality of vertically extending columns, each being thermally insulated to minimize differential movement between said columns, each column further comprising:

(i) a leveling means mounted to the lower portion of said column;

(ii) a girder engagement means, including a pair of projecting U-shaped plate members, welded to the top portion of said column;

(b) a plurality of parallel spaced apart girders, supported and engaged by said columns said engagement allowing limited lateral movement therebetween;

(c) a plurality of grid bars arranged in families, located on top of and in a direction transverse to said girders, each family having a first end adapted for engaging an adjacent family, and a second end adapted for terminating near the blast stove wall, each of said families comprising:

(i) at least four elongate grid bars having tapered top portions, each grid bar held in parallel spaced relation by welded spacers;

(ii) at least two rods extending transversely through and welded to said grid bars, a first rod located at the first end of said family and a second rod located intermediate the first and second ends of said family, said rods preventing relative longitudinal movement between said grid bars;

(iii) family interlocking members rotatably mounted to the first transverse rod of a certain of said families, each of said members including a downwardly extending slot having a radiused lower portion and adapted to loosely receive a portion of the first transverse rod of the adjacent family, said member further provided with a slot in its bottom portion adapted to loosely engage a girder;

(iv) girder engaging members rotatably mounted to the second rod, each of said members including a slot in the bottom portion adapted to loosely engage a girder;

(v) tab members extending orthogonally from the welded to the grid bars at suitable locations each tab member having a tapered top portion;

(vi) a transverse plate welded to the second end of each family, said plate preventing the intrusion of the individual grid bar ends into the refractory wall upon movement of the family;

(d) a plurality of grid shoes forming a uniform layer on top of said grid bars, each grid shoe comprising:

(i) a metallic structure dimensioned to support three checkerbricks;

(ii) vertical flow passages disposed uniformly in said structure;

(iii) a first set of parallel grooves for engaging the tapered portions of the grid bars, said grooves disposed in the bottom surface of said shoe and positioned between successive rows of flow passages;

(iv) a second set of parallel grooves for engaging the tab members, said second set disposed in the bottom surface of said shoe transversely to the first set; and, (v) recesses in the top surface of said shoes concentric with selected flow passages, said recesses being adapted to receive companion projections located on the lower surface of the checkerbricks, said recesses and projections interlocking said grid shoes and checkerbricks to limit relative lateral movement therebetween.

9. In a blast furnace stove, a checkerwork support structure comprising:

(a) a plurality of vertically extending columns including a girder engagement means mounted to the top portion of each column;

(b) a plurality of parallel spaced apart girders supported and engaged by said columns, said engagement allowing controlled limited lateral movement between said girders and said columns;

(c) families of grid bars located on top of and in a direction transverse to said girders, each family having at least one end adapted for engaging an adjacent family, each of said families comprising:

(i) a plurality of grid bars, each of said grid bars held in parallel spaced relation by spacers fixed to adjacent bars;

(ii) at least two transverse members extending through and fixed to said grid bars, a first transverse member located at the one end of said family and a second transverse member located intermediate the one end and the other end of said family, said transverse members preventing relative longitudinal movement between said grid bars;

(iii) family interlocking means loosely mounted to the first transverse member of a certain of said families, each of said means including a slot adapted to loosely receive a portion of the first transverse member of an adjacent family, said means further including a girder engagement portion, adapted to loosely engage a girder to permit limited lateral movement therebetween;

(iv) girder engaging means loosely mounted to the second transverse member, said means including a girder engaging portion adapted to loosely engage the girder and provide limited lateral movement therebetween;

(v) grid shoe engaging members mounted to the grid bars at suitable locations;

(d) a plurality of grid shoes forming a uniform layer on top of said grid bars, each grid shoe comprising:

(i) a structure dimensioned to support a plurality of checkerbricks;

(ii) vertical flow passages disposed in said structure;

(iii) a first set of grooves for engaging the grid bars, disposed in the bottom surface of said shoe;

(iv) a second set of grooves for engaging the grid shoe engaging members, said second set disposed in the bottom surface of said shoe; and, (v) checkerbrick engaging means disposed on the top surface of said shoes, said checkerbrick engaging means configured to allow controlled lateral movement between said shoes and said checkerbricks.

10. For a checker chamber in a blast furnace stove having horizontally extending support girders, a grid shoe support structure comprising families of grid bars located on top of and extending in a direction transverse to said girders, each family having at least one end adapted for engaging an adjacent family, each of said families comprising:

(a) a plurality of grid bars, each of said grid bars held in parallel spaced relation by spacers fixed to adjacent bars;

(b) at least two transverse members extending and fixed to said grid bars, a first transverse member located at the one end of said family and a second transverse member located intermediate the one end and the other end of said family, said transverse members preventing relative longitudinal movement between said grid bars;

(c) family interlocking means loosely mounted to the first transverse member of a certain of said families, each of said means including a slot adapted to loosely receive a portion of the first transverse member of an adjacent family, said means further including a girder engagement portion, adapted to loosely engage a girder to provide limited lateral movement therebetween;

(d) girder engaging means loosely mounted to the second transverse member, said means including a girder engaging poriton adapted to loosely engage the girder and provide limited lateral movement therebetween; and, (e) grid shoe engaging members mounted to the grid bars at suitable locations.

11. A blast furnace stove comprising:

(a) a combustion chamber;

(b) a regenerative chamber;

(c) means communicating said combustion chamber and said regenerative chamber;

(e) a structure for supporting said checkerbricks, said structure comprising:

(i) horizontal extending girders;

(ii) girder supporting means including a girder engagement means allowing limited lateral movement between said girders and said girder supporting means;

(iii) a plurality of grid bars supported by said girders, said grid bars interlocked to each other and to said girders, said interlocking allowing limited lateral movement between said grid bars and said girders; and, (iv) a plurality of grid shoes supported by said grid bars, said grid shoes loosely engaged by said grid bars, said engagement allowing limited lateral movement between said grid bars and said grid shoes, said grid shoes further including means for interlocking the first layer of checkerbricks to said grid shoes, said means for interlocking allowing limited lateral movement between said first layer of checkerbricks and said grid shoes.

12. For use in a blast stove, a grid bar assembly comprising:

(a) a plurality of spaced grid bar members;

(b) a plurality of grid bar connector members disposed transversely of and connected to the grid bar members to maintain the bar members in fixed spaced relationship for support of a checkerbrick assembly;

(c) a plurality of support elements connected to certain of the members and including lower surfaces configured to engage and loosely interlock with an underlying support structure, said support elements permitting thermally induced relative movement between said grid bar assembly and said support structure within predetermined limits; and, (d) the assembly including interlock means adapted to connect a similar assembly in relatively movable relationship while constraining the relative movement within predetermined limits.

13. The assembly of claim 12 wherein certain of the support elements are each rotatively mounted on an associated member.

14. The assembly of claim 12 wherein certain of the support elements include and provide the interlock means.

15. A grid bar assembly for use in a blast stove comprising:

(a) a plurality of grid bars positioned in spaced, parallel relationship, each grid bar including tapered upper surfaces;

(b) a plurality of grid bar connecting rods extending through and connected to the grid bars for maintaining the grid bars in their parallel spaced relationship;

(c) a plurality of support plates each rotatively mounted on a rod and each including a lower notch for supportively engaging a girder in limited relatively movable relationship;

(d) a plurality of latching plates each rotatively mounted on an associated rod, each of the latching plates including a normally upwardly oriented notch for loosely engaging a rod of another assembly to maintain relative assembly movement within predetermined limits; and, (e) a plurality of shoe locating tabs each fixed to and projecting transversely of an associated grid bar, the tabs each including tapered upper surfaces and the tabs and bars being adapted to support grid shoes while loosely engaging the grid shoes to maintain relative movement of such assembly and a supported shoe within predetermined limits in orthogonally related directions.

16. The assembly of claim 15 wherein each of the latching plates includes a lower notch for supportively engaging a girder in limited relatively movable relationship.

17. The assembly of claim 15 further including a plurality of spacing plates each, between and fixed to, two of the grid bars.

18. A blast stove heat storage construction comprising:

(a) a plurality of upwardly disposed load supporting columns:

(b) a plurality of girders mounted on the columns in loosely interlocked relationship to permit relative movement over a predetermined range;

(c) a set of grid bar assemblies mounted on the girders, loosely interlocked to each other and to said girders, said interlocking permitting relative movement within predetermined limits;

(d) apertured checkerbrick shoes mounted on the assemblies and loosely interlocked against movement in any lateral direction beyond predetermined limits; and, (e) an interlocked array of checkerbricks mounted on the shoes.

19. The construction of claim 18 wherein each of the loosely interlocked relationships limits relative lateral movement in two transverse directions.

20. The construction of claim 18 wherein the assemblies are loosely interlocked together for limited relative movement.

21. The construction of claim 18 wherein each column to girder interlock is provided by a pair of spaced saddles fixed to a selected one of a column upright and the girder and an engagement plate between arms of each saddle and including projections extending laterally between the saddle, the engagement plate being fixed to the other one of the column upright and girder.

22. The construction of claim 18 wherein each assembly to girder interlock is provided by a pivotally mounted notch plate.

23. The construction of claim 18 wherein each of the assemblies defines vertically extending spaces and wherein the shoe apertures are aligned with the spaces to provide unobstructed vertical flow.

24. A blast stove heat storage construction comprising:

(a) a plurality of upwardly disposed load supporting columns;

(b) a plurality of girders mounted on the columns in loosely interlocked relationship to permit relative movement over a predetermined range;

(c) a set of grid bar assemblies mounted on the girders;

(d) each of the assemblies comprising:

(i) a plurality of spaced grid bar members;

(ii) a plurality of grid bar connector members disposed transversely of and connected to the grid bar members to maintain the bar members in spaced relationship;

(iii) a plurality of support elements connected to certain of the members and including lower surfaces engaging a coacting girder to permit thermally induced relative movement within predetermined limits; and, (iv) certain of the assemblies including interlock means each connecting an adjacent assembly in relatively movable relationship while constraining the relative movement within predetermined limits;

(e) apertured checkerbrick shoes mounted on the assemblies and loosely interlocked against movement in any lateral direction beyond predetermined limits; and, (f) an interlocked array of checkerbricks mounted on the shoes.

25. In a blast furnace stove checker chamber having support girders and a grid bar structure comprising a plurality of grid bar assemblies located on said girders, each of said assemblies comprising:

(a) a plurality of grid bars extending transverse to said girders;

(b) transverse members fixed to said grid bars to maintain said bars in assembled spaced relation; and (c) co-engagement means for interlocking said assemblies to each other and to said girders, said means allowing controlled lateral movement within predetermined limits, between said assemblies and said girders.

26. The structure of claim 25 wherein said means for interlocking said assemblies comprises an interlocking member loosely engaged by a certain of said transverse members of said assemblies, each interlocking member including a slot adapted to loosely receive a transverse member of an adjacent grid bar assembly.

27. The structure of claim 26 wherein said interlocking member further includes a girder engagement portion adapted to loosely engage a support girder to provide limited lateral movement therebetween.

28. The structure of claim 25 wherein said transverse members include spacers welded between adjacent grid bars and further including rods extending transversely through and welded to said grid bars.

29. The structure of claim 1 wherein said means for interlocking said assemblies to each other and to said girders comprises a first interlocking member loosely engaged by a certain of said transverse members of said assemblies adapted to loosely receive a transverse member of an adjacent assembly to provide limited relative lateral movement between the interlocked assemblies, said means further including a second interlocking member loosely engaged by a certain of said transverse members of said assemblies adapted to loosely engage a support girder to provide limited lateral movement therebetween.

* * * * *

UNITED STATES PATENT AND TRADEMARK OFFICE

CERTIFICATE OF CORRECTION

PATENT NO. : 4,235,593

DATED : November 25, 1980

INVENTOR(S) : William H. Malone

It is certified that error appears in the above-identified patent and that said Letters Patent are hereby corrected as shown below:

Column 1, line 11, "or" should be --of--.
Column 8, line 43, "against" should be --adjacent--.
Column 10, lines 45 and 46, "catustrophic" should be --catastrophic--.
Column 11, line 2, "gird" should be --grid--.
Column 13, line 18, "the" should be --and--.
Column 14, line 61, "poriton" should be --portion--.
Column 18, line 29, "1" should be --25--.

Signed and Sealed this

Tenth Day of March 1981

[SEAL]

Attest:

RENE D. TEGTMEYER

Attesting Officer

Acting Commissioner of Patents and Trademarks